United States Patent [19]

Rogers

[11] Patent Number: 4,603,288

[45] Date of Patent: Jul. 29, 1986

[54] DUAL REGULATED POWER SUPPLY

[75] Inventor: Jerrold J. Rogers, Beaverton, Oreg.

[73] Assignee: Tektronix, Inc., Beaverton, Oreg.

[21] Appl. No.: 672,745

[22] Filed: Nov. 19, 1984

[51] Int. Cl.[4] ..... G05F 1/563

[52] U.S. Cl. ..... 323/234; 363/15; 363/84

[58] Field of Search ..... 323/234; 363/15, 19, 363/28, 78, 84; 331/183

[56] References Cited

U.S. PATENT DOCUMENTS 3,764,881 10/1973 Thomas ..... 363/19

*Primary Examiner*—Patrick R. Salce
*Assistant Examiner*—Jeffrey Sterrett
*Attorney, Agent, or Firm*—John P. Dellett; Francis I. Gray; Robert S. Hulse

[57] ABSTRACT

A dual regulated DC power supply produces an output voltage which is the sum of a variable DC control voltage and a floating DC voltage. The control voltage, generated by a first differential amplifier having an inverted input coupled to the power supply output through a feedback scaling circuit, varies in inverse relation to the change in power supply output voltage. The floating DC voltage is produced by isolating, rectifying and filtering the output of an oscillator having a peak voltage controlled by an applied bias voltage. The applied bias voltage is generated by a second differential amplifier coupled to compare the control voltage with a selected reference voltage so that a change in control voltage causes a change in the floating voltage. The control voltage changes rapidly in compensating response to transient changes in power supply voltage while the floating voltage changes more slowly in compensating response to output voltage changes due to sustained load swings.

10 Claims, 2 Drawing Figures

DUAL REGULATED POWER SUPPLY

BACKGROUND OF THE INVENTION

The present invention relates to power supplies in general and more particularly to power supplies incorporating feedback circuits to regulate DC output voltage.

Many prior art power supplies, particularly high voltage power supplies, have used an oscillator to produce a sinusoidal AC voltage of a desired amplitude which is then rectified and filtered to produce a DC output. To improve the regulation of such power supplies, the DC output voltage is sampled and used in a feedback arrangement to control the peak voltage of the oscillator. A drop in DC output voltage due, for instance, to an increase in power supply load causes a corresponding increase in oscillator peak voltage. The increase in oscillator peak voltage then results in an increase in DC output voltage to compensate for the original drop. Likewise, a decrease in power supply DC output voltage would cause an increase in oscillator peak voltage and a subsequent compensating increase in DC output voltage.

Unfortunately, in many applications the response of the oscillator driven power supply to a change in feedback control voltage is too slow to regulate for high frequency output voltage transients. Since the DC output voltage of such a power supply is a function of the peak voltage of the oscillator, it may take as much as one cycle of the oscillator output signal before the change in applied oscillator peak voltage is perceived by the rectifying and filtering circuits. Further, once a change in oscillator peak voltage occurs, capacitors in the filtering circuits of the power supply require additional time to charge or discharge to the desired DC output voltage level. Depending on the relative size of the capacitors and the load impedance, the capacitor charge or discharge time can be considerable.

Therefore what is needed is a regulated power supply capable of fast and accurate compensating response to a small transient change in DC output voltage while also being capable of compensating for wide swings in output voltage due to load changes.

SUMMARY OF THE INVENTION

In accordance with the present invention in a preferred embodiment thereof, a power supply comprises an oscillator, providing an input to a rectifying and filtering circuit, and a first and second differential amplifier connected in a feedback arrangement to regulate the power supply DC output voltage. The oscillator output voltage peak is controlled by an applied bias voltage. The rectifying and filtering circuit produce a floating DC output voltage proportional to the oscillator output voltage peak.

The power supply DC output voltage, taken at the high side of the rectifying and filtering circuit floating output, is coupled through a feedback scaling circuit to the inverting input of the first differential amplifier while the noninverting input of the amplifier is grounded. The output of the first amplifier is coupled to the low side of the rectifying and filtering circuit floating output such that the DC output voltage of the power supply is equal to the sum of the output voltages of the rectifying and filtering circuit and the differential amplifier.

The output voltage of the first differential amplifier is also coupled to the noninverting input of the second differential amplifier, the second amplifier having a reference voltage applied to its inverting input. The output voltage of the second differential amplifier is applied as the bias voltage for the oscillator.

Any change in the DC output voltage of the power supply is negatively fed back to the first differential amplifier, rapidly producing an opposite change in the amplifier output voltage for compensating the initial change in DC output voltage. The change in output voltage of the first differential amplifier is also negatively fed back to the second differential amplifier producing a compensating change in oscillator peak voltage and subsequently a corresponding change in the rectifying and filtering circuit output voltage.

The first differential amplifier operates quickly to regulate transient, low amplitude changes in power supply output voltage, while the second differential amplifier, controlling the oscillator peak voltage, operates more slowly to compensate for long-term, high-magnitude changes in power supply load.

It is therefore an object of the present invention to provide a new and improved oscillator type DC power supply characterized by accurate output voltage regulation over a wide load range.

It is another object of the present invention to provide a new and improved oscillator type DC power supply having a fast regulating response to small, transient changes in output voltage.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a block diagram of a power supply incorporating the present invention, and FIG. 2 is a schematic diagram of a rectifying and filtering circuit suitable for use in conjunction with the power supply of FIG. 1.

DETAILED DESCRIPTION

Figure 1:
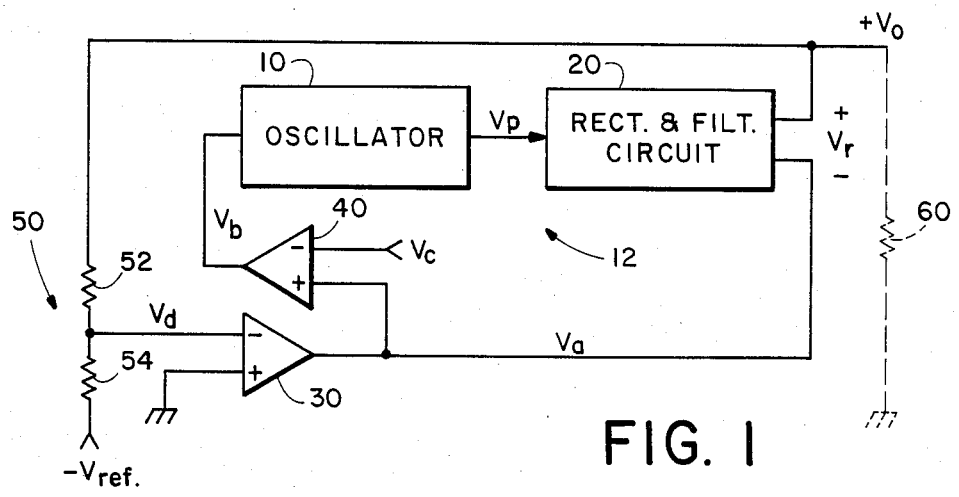

Referring to FIG. 1, the power supply according to the present invention, illustrated in block diagram form, is adapted to produce a regulated DC output voltage $V_o$. The power supply comprises means 12 to generate a floating DC voltage $V_r$ proportional to an applied biasing voltage $V_b$, a first differential amplifier 30 for producing DC output voltage $V_a$, a second differential amplifier 40 for producing the biasing voltage $V_b$, and a feedback scaling circuit 50.

Figure 2:
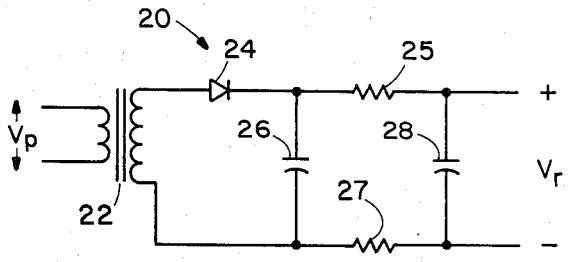

In the preferred embodiment, floating voltage generating means 12 comprises oscillator 10 and filtering and rectifying circuit 20. Oscillator 10 is of the type providing a sinusoidal or other AC output voltage waveform wherein the peak output voltage varies with applied bias voltage $V_b$. Such oscillators are common in the art and are not further detailed herein. Rectifying and filtering circuit 20 is of the type having a floating DC output voltage $V_r$ varying with the applied output voltage peak of oscillator 10. FIG. 2 is a schematic diagram of a typical such rectifying and filtering circuit 20 which, in addition to rectifying and filtering the output of oscillator 10, includes transformer 22 isolating $V_r$ from ground such that the output of circuit 20 is a floating voltage. Transformer 22 may also be utilized to step up the output voltage of oscillator 10.

The stepped-up oscillator voltage appearing across the secondary winding of transformer 22 is half-wave rectified by diode 24 coupled to one side of the transformer secondary and then applied across capacitor 26. Capacitor 26 is coupled in parallel with capacitor 28 through resistors 25 and 27. Capacitors 26 and 28 smooth the rectified transformer 22 secondary voltage to produce floating DC output voltage $V_r$ across capacitor 28. If capacitors 26 and 28 are large enough for a given power supply load, the drop in $V_r$ due to capacitor 26 and 28 discharge during the off-peak swing of the rectified transformer secondary voltage is small enough that $V_r$ remains relatively constant throughout each cycle of oscillator 10.

Referring again to FIG. 1, the DC output voltage $V_o$ of the power supply, taken at the high side of the rectifying and filtering circuit 20 output, is coupled through feedback scaling circuit 50 to an inverting input of first differential amplifier 30. Feedback scaling circuit 50, in the preferred embodiment, comprises series connected resistors 52 and 54 interposed between the positive DC output voltage $V_o$ and a negative reference voltage $V_{ref}$. The junction of resistors 52 and 54 is connected to the inverting input of amplifier 30. The noninverting input of amplifier 30 is grounded. Resistors 52 and 54 comprise a voltage divider and are sized such that for a desired nominal power supply output voltage, $V_o$, the voltage $V_d$ applied to amplifier 30 is also substantially at ground.

The output of amplifier 30, DC voltage $V_a$, is coupled to the low end of the floating output of rectifying and filtering circuit 20. Thus the DC output voltage $V_o$ of the power supply is equal to the sum of the output voltage $V_r$ of the floating rectifying and filtering circuit 20, and the output voltage $V_a$ of first differential amplifier 30. In a typical application, $V_r$ will be much larger than $V_a$ and will therefore remain approximately equal to $V_o$ during steady state operation.

The output voltage $V_a$ of first differential amplifier 30 is also applied to the noninverting input of second differential amplifier 40, while reference voltage $V_c$ is applied to the inverting input of amplifier 40. The output voltage of amplifier 40, proportional to the difference between $V_a$ and $V_c$, is applied as bias voltage $V_b$ to oscillator 10. With the gain of amplifier 40 high, $V_a$ will remain substantially equal to $V_c$ during steady state power supply operation. Therefore $V_c$ is selected such that the oscillator feedback loops maintain $V_a$ at an optimum operating voltage for the output stage of amplifier 30. It may be ground for a bipolar output, or a positive or negative voltage near the center of the operating range of a uni-polar output stage. It is typically small compared to $V_r$.

In operation, any transient increase in the DC output voltage $V_o$ of the power supply above the nominal value causes feedback voltage $V_d$ to rise driving output voltage $V_a$ of amplifier 30 negative. Since DC output voltage $V_o$ is equal to the sum of $V_r$ and $V_a$, the drop in $V_a$ causes a compensating drop in $V_o$. To insure stability of the feedback circuit, the gain of amplifier 30 is such that the compensating drop in $V_a$ does not exceed the initial rise in $V_o$. This compensating change in $V_a$ occurs rapidly; the speed of change in $V_a$ is not dependent on the cycle time of oscillator 10 or on the discharge time of any capacitors in circuit 20, but instead depends primarily on the response time of amplifier 30 which can be comparatively short for most commonly available differential amplifiers. However the output voltage range for most differential amplifiers is limited. Thus changes in $V_a$ normally compensate only for the small, transient swings in $V_o$.

To compensate for adjustment range, system tolerances, input voltage swing and long term changes in power supply load, the floating voltage $V_r$ changes. A decrease in load will cause an initial rise in $V_o$ and consequently a drop in $V_a$. When the output voltage $V_a$ of first differential amplifier 30 falls, the output voltage $V_b$ of second differential amplifier 40, proportional to the difference between $V_a$ and $V_c$, decreases causing a proportional decrease in oscillator 10 output voltage $V_p$. When the voltage peak of $V_p$ decreases, capacitors in rectifying and filtering circuit 20 discharge proportionately, driving $V_r$ lower. The reduction in $V_r$ resulting from an increase in $V_o$ occurs some time after the change in $V_a$, the delay being due to the cycle time of oscillator 10 and the discharge times of filtering capacitors in circuit 20.

An increase in $V_o$ due to a sustained change in power supply load results first in a drop in $V_a$ and then in a subsequent decrease in $V_r$. The resulting drop in $V_o$ causes a drop in $V_d$. Amplifier 30 responds by driving $V_a$ more positive thereby increasing $V_b$ and the peak voltage output of oscillator 10 and driving $V_r$ somewhat higher. Thus the initial rapid compensating decrease in $V_a$ in response to the change in $V_o$ is followed by somewhat slower decrease in $V_r$ accompanied by a secondary increase in $V_a$ such that $V_a$ settles at its normal operating value near $V_c$ while $V_r$ settles at a value near the nominal value of $V_o$. Thus for a sustained load decrease, a resulting increase in $V_o$ is initially corrected in large part by a rapid decrease in $V_a$ but is eventually corrected by a decrease in $V_r$ with $V_a$ returning essentially to $V_c$.

The present invention compensates for decreases in $V_o$ in a similar fashion. A decrease in $V_o$ drives $V_d$ lower, causing amplifier 30 to increase $V_a$ in the positive direction. The increase in $V_a$ drives $V_o$ higher in compensation for the initial decrease in $V_o$. The increase in $V_a$ also causes amplifier 40 to increase $V_b$, increasing in turn the peak output voltage of oscillator 10, and thereby increasing rectifier and filter circuit 20 floating output voltage $V_r$. The resulting increase in $V_o$ causes a secondary decrease in $V_a$. Likewise, a decrease in $V_o$ will therefore cause an initial compensating increase in $V_a$ and a subsequent compensating increase in $V_r$ with $V_a$ returning to $V_c$.

The preferred embodiment, as depicted in FIG. 1, produces a positive DC output voltage $V_o$. However a negative DC output voltage $V_o$ could be generated using essentially the same circuit topology by reversing the polarity of $V_r$, $V_{ref}$, and the inputs to amplifiers 30 and 40.

Oscillator 10 of FIG. 1 has been depicted as being of the type having a peak output voltage varying with applied bias voltage $V_b$. An oscillator of the type 10 having a peak output voltage varying inversely with applied bias voltage $V_b$ could also be used by reversing the $V_a$ and $V_c$ inputs to amplifier 40.

Thus the present invention comprises a power supply incorporating two feedback loops to regulate output voltage. The first loop, comprising feedback scaling circuit 50 and amplifier 30, provides rapid compensation for transients in supply voltage. The second loop, comprising feedback scaling circuit 50, amplifier 30 and amplifier 40, provides slower but wider ranging compensation. The unique coupling of the feedback loops ensures that the fast amplifier is maintained in the center of its operating range and only needs a small dynamic range.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A power supply for generating a regulated DC power supply output voltage comprising:

means to produce a DC floating voltage including means for causing said floating voltage to vary in inverse relation to changes in the power supply output voltage, and means to produce a DC control voltage varying in inverse relation to changes in the power supply output voltage, the control voltage and the floating voltage being summed to produce the power supply output voltage such that changes in powe supply output voltage produce compensating changes in the floating and control voltages.

2. A power supply for generating a regulated DC output voltage comprising:

means to produce a floating DC voltage of magnitude controlled by an applied bias voltage, means to produce a DC control voltage varying in inverse relation to changes in the power supply output voltage, the control voltage and the floating voltage being summed to produce the power supply output voltage, and means to generate the bias voltage, the bias voltage varying with the difference between the control voltage and a selected reference voltage.

3. A power supply for generating a regulated DC output voltage of a nominal magnitude comprising:

means to produce a floating DC voltage of magnitude controlled by an applied bias voltage, means to produce a DC control voltage varying in inverse relation to changes in the power supply output voltage from the nominal magnitude, the control voltage and the floating voltage being summed to produce the power supply output voltage, and means to generate the bias voltage, the bias voltage varying with the difference between the control voltage and a reference voltage, the reference voltage being selected to adjust the nominal power supply output voltage magnitude.

4. A power supply as in claim 3 wherein the means to produce the floating DC voltage comprises:

an oscillator for producing an AC voltage having a peak magnitude controlled by the applied bias voltage, and means to produce the floating DC voltage in proportion to the oscillator peak voltage.

5. A power supply as in claim 3 wherein the means to produce the floating DC voltage comprises:

a transformer having a primary and a secondary winding, an oscillator for producing an AC voltage of peak magnitude controlled by the applied bias voltage, the AC voltage being applied to the transformer primary to produce a transformer output voltage across the secondary winding, means to rectify the transformer output voltage, and means to produce the floating DC voltage by filtering the rectified transformer output voltage.

6. A power supply as in claim 3 wherein the means to generate the bias voltage comprises a differential amplifier.

7. A power supply as in claim 3 wherein the means to produce the DC control voltage comprises:

a feedback scaling circuit coupled to produce a feedback voltage proportional to the deviation of the power supply output voltage from the nominal magnitude, and a differential amplifier having an inverting input coupled to receive the feedback voltage and generate the control voltage output in inverse relation to the feedback voltage.

8. A power supply as in claim 7 wherein the feedback scaling circuit comprises:

a source of reference voltage, and a voltage divider coupling the reference voltage source to the power supply output and producing the feedback voltage.

9. A power supply for generating a regulated DC output voltage of a nominal magnitude comprising:

means to produce a floating DC voltage of magnitude controlled by an applied bias voltage, a feedback scaling circuit coupled to produce a feedback voltage proportional to the deviation of the power supply output voltage from the nominal magnitude, a first differential amplifier having an inverting input coupled to receive the feedback voltage and generate a control voltage inverse relation to the feedback voltage, and a second differential amplifier coupled to generate the bias voltage, the bias voltage varying with the differential between the control voltage and a reference voltage, the reference voltage being selected to adjust the nominal power supply output voltage.

10. A power supply for generating a regulated DC output voltage of a nominal magnitude comprising:

an oscillator for producing an AC voltage having a peak magnitude controlled by an applied bias voltage, means to produce a floating DC voltage in proportion to the oscillator peak voltage, a feedback scaling circuit coupled to produce a feedback voltage proportional to the deviation of the power supply output voltage from the nominal magnitude, a first differential amplifier having an inverting input coupled to receive the feedback voltage and generate a control voltage output in inverse relation to the feedback voltage, and a second differential amplifier coupled to generate the bias voltage, the bias voltage varying with the differential between the control voltage and a reference voltage, the reference voltage being selected to adjust the nominal power supply output voltage.

* * * * *